US012196205B2

(12) United States Patent
Luo

(10) Patent No.: US 12,196,205 B2
(45) Date of Patent: Jan. 14, 2025

(54) LOW-PRESSURE CHAMBER ROTARY COMPRESSOR AND AIR CONDITIONER

(71) Applicant: GUANGZHOU DESHAN CNC TECHNOLOGY CO., LTD., Guangdong (CN)

(72) Inventor: Yingxue Luo, Guangdong (CN)

(73) Assignee: GUANGZHOU DESHAN CNC TECHNOLOGY CO., LTD., Guangzhou (CN)

( * ) Notice: Subject to any disclaimer, the term of this patent is extended or adjusted under 35 U.S.C. 154(b) by 0 days.

(21) Appl. No.: 18/561,825

(22) PCT Filed: Feb. 22, 2022

(86) PCT No.: PCT/CN2022/077321
§ 371 (c)(1),
(2) Date: Nov. 17, 2023

(87) PCT Pub. No.: WO2023/060816
PCT Pub. Date: Apr. 20, 2023

(65) Prior Publication Data

US 2024/0271621 A1 Aug. 15, 2024

(30) Foreign Application Priority Data

Oct. 15, 2021 (CN) ..... 202111205587.6

(51) Int. Cl.
*F04C 18/356* (2006.01)
*F04C 29/02* (2006.01)
*F04C 29/06* (2006.01)

(52) U.S. Cl.
CPC ..... *F04C 18/3568* (2013.01); *F04C 18/3564* (2013.01); *F04C 29/026* (2013.01);
(Continued)

(58) Field of Classification Search
CPC ..... F04C 23/008; F04C 2240/30; F04C 2240/603; F04C 2240/605;
(Continued)

(56) References Cited

U.S. PATENT DOCUMENTS 5,226,797 A 7/1993 Da Costa
2005/0069423 A1* 3/2005 Ebara ..... F04C 23/001 418/11
2008/0078618 A1* 4/2008 Lee ..... F04C 18/3564 418/63

FOREIGN PATENT DOCUMENTS

CN 1041638 A 4/1990
CN 202659512 U 1/2013
(Continued)

OTHER PUBLICATIONS

CN103939343A—Wu et al.—A Low Back Pressure Of The Rolling Piston Type Refrigeration Compressor—Jul. 23, 2014—the English Machine Translation. (Year: 2014).*
(Continued)

*Primary Examiner* — Theresa Trieu
(74) *Attorney, Agent, or Firm* — Dorf Nelson & Zauderer LLP; Scott D. Locke, Esq.

(57) ABSTRACT

A rotary compressor with a low-pressure chamber and an air conditioner are disclosed. The rotary compressor with a low-pressure chamber includes a housing, a motor assembly and a pump assembly. The housing is provided with a low-pressure air inlet component and a high-pressure air outlet component, a low-pressure chamber is arranged in the housing, the motor assembly is arranged in the low-pressure chamber. The motor assembly includes a stator and a rotor. The pump assembly includes a crankshaft, a crankshaft shell, a cylinder, a piston, a sliding vane and a bearing, the pump assembly is arranged in the low-pressure chamber. The piston, the sliding vane, the cylinder, the bearing and the
(Continued)

crankshaft shell cooperatively form a compression chamber. A low-pressure refrigerant directly cools the rotor and the stator, and the low-pressure refrigerant is heated to vaporize, so as to increase a temperature of a gaseous refrigerant before compression.

13 Claims, 9 Drawing Sheets

(52) U.S. Cl.
CPC ..... *F04C 29/068* (2013.01); *F04C 2240/30* (2013.01); *F04C 2240/605* (2013.01); *F04C 2240/806* (2013.01); *F04C 2240/809* (2013.01)

(58) Field of Classification Search
CPC ..... F04C 2240/809; F04C 29/023; F04C 29/025; F04C 29/026; F04C 29/028; F04C 29/06; F04C 29/065; F04C 29/066; F04C 29/068; F04C 29/126; F04C 29/128
See application file for complete search history.

(56) References Cited

FOREIGN PATENT DOCUMENTS

| | | | |
|---|---|---|---|
| CN | 202926630 | U | 5/2013 |
| CN | 103939343 | A | 7/2014 |
| CN | 203742931 | U | 7/2014 |
| CN | 104088791 | A | 10/2014 |
| CN | 104314814 | A | 1/2015 |
| CN | 104819155 | A | 8/2015 |
| CN | 204627989 | U | 9/2015 |
| CN | 106382227 | A | 2/2017 |
| CN | 107313941 | A | 11/2017 |
| CN | 207005071 | U | 2/2018 |
| CN | 108005901 | A | 5/2018 |
| CN | 110219803 | A | 9/2019 |
| CN | 110425136 | A | 11/2019 |
| CN | 110925211 | A | 3/2020 |
| CN | 111720312 | A | 9/2020 |
| CN | 111720326 | A | 9/2020 |
| CN | 111734634 | A | 10/2020 |
| CN | 112360742 | A | 2/2021 |
| CN | 113915129 | A | 1/2022 |
| JP | 01305187 | A | 7/1991 |
| KR | 960002186 | U | 1/1996 |
| WO | 2016/179765 | A1 | 11/2016 |
| WO | 2017/221398 | A1 | 12/2017 |
| WO | 2023/029391 | A1 | 3/2023 |
| WO | 2023/060816 | A1 | 4/2023 |

OTHER PUBLICATIONS

CN104088791A—Cheng et al.—A Cylinder And Rotary Compressor For Rotating Compressor—Oct. 8, 2014—the English Machine Translation. (Year: 2014).*

CN104314814A—Qian et al.—Rotary Compressor With Low Back Pressure—Jan. 28, 2015—the English Machine Translation. (Year: 2015).*

CN111720326A—Yang et al.—Novel Swinging Rotor Compressor With Low-pressure Cavity In Shell—Sep. 29, 2020—the English Machine Translation. (Year: 2020).*

Office Action, Chinese Application Serial No. 2021112055876, May 17, 2022 (and translation).

Chinese Intellectual Property Office Search Report for Chinese Application Serial No. 2021112055876 (and translation).

Office Action, Chinese Application Serial No. 2022108166989, Feb. 3, 2023 (and translation).

Chinese Intellectual Property Office Search Report for Chinese Application Serial No. 2022108166989 (and translation).

Chinese Intellectual Property Office, Supplemental Search Report for Chinese Application Serial No. 2022108166989 (and translation).

WIPO International Search Report for PCT application serial No. PCT/CN2022/077321, Jul. 20, 2022.

WIPO Written Opinion for PCT application serial No. PCT/CN2022/077321, Jul. 20, 2022.

* cited by examiner

LOW-PRESSURE CHAMBER ROTARY COMPRESSOR AND AIR CONDITIONER

CROSS-REFERENCE TO RELATED APPLICATIONS

This application is a national stage filing under 35 U.S.C. § 371 of international application number PCT/CN2022/077321, filed Feb. 22, 2022, which claims priority to Chinese patent application No. 2021112055876 filed Oct. 15, 2021. The contents of these applications are incorporated herein by reference in their entirety.

TECHNICAL FIELD

The disclosure relates to the field of compressors, and in particular to a rotary compressor with a low-pressure chamber and an air conditioner.

BACKGROUND

In daily production and life, compressors may be classified into piston compressors, rotary compressors and scroll compressors according to working principles thereof. Among them, the rotary compressors are widely used and developed in the refrigeration industry due to their high energy efficiency ratio and mature processing technology. However, the existing rotary compressor has many shortages in structure. The motor of the existing rotary compressor operates in a high temperature environment all the time, which affects the lifespan and the energy efficiency ratio of the motor. Moreover, the main pump of the traditional rotary compressor is enclosed within a high-pressure chamber that stores a high-pressure refrigerant and has many components (bearing, cylinder, crankshaft, piston and sliding vane). At the same time, thermal deformation parameters of materials of the components are quite different. During the compression of a low-pressure refrigerant, the thermal expansion of the components in the high-pressure chamber increases the sealing gap, which leads to high-pressure gas leaking into the low-pressure chamber through the gap during each compression action, resulting in poor compression effect on the refrigerant.

SUMMARY

The disclosure aims at least solving one of the technical problems in the existing technology. For this purpose, the disclosure proposes a rotary compressor with a low-pressure chamber.

The disclosure further proposes an air conditioner comprising the rotary compressor with a low-pressure chamber.

The rotary compressor with a low-pressure chamber according to an embodiment in a first aspect of the disclosure, comprises:

a housing, wherein a low-pressure chamber filled with a low-pressure refrigerant is arranged in the housing, and the housing is provided with a low-pressure air inlet component for introducing the low-pressure refrigerant and a high-pressure air exhaust component for discharging a high-pressure refrigerant;

a motor assembly, wherein the motor assembly is arranged in the low-pressure chamber, and the motor assembly comprises a stator, a rotor and upper and lower balance blocks;

a pump assembly, wherein the pump assembly is arranged in the low-pressure chamber, the pump assembly comprises a crankshaft, a crankshaft shell, a cylinder, a piston, a sliding vane and a bearing; the piston, the sliding vane, the cylinder, the bearing and the crankshaft shell cooperatively form a compression chamber, the cylinder is provided with a sliding vane groove, the sliding vane is arranged in the sliding vane groove, and the sliding vane cooperates with the piston to divide the compression chamber into a low-pressure area and a high-pressure area; and the crankshaft shell is provided with a low-pressure air inlet port, the pump assembly is provided with a cylinder air intake hole and a high-pressure air exhaust port, a position of the low-pressure air inlet port corresponds to a position of the low-pressure air inlet component, and the high-pressure air exhaust port is connected with the high-pressure air exhaust component;

wherein, the crankshaft and the piston are arranged in the cylinder, and the cylinder, the bearing and the sliding vane are arranged in the low-pressure chamber.

The rotary compressor with a low-pressure chamber according to the embodiment in the first aspect of the disclosure at least has the following beneficial effects. A housing is provided with a low-pressure air inlet component and a high-pressure air outlet component, a low-pressure chamber is arranged in the housing, a motor assembly is arranged in the low-pressure chamber, the motor assembly comprises a stator, a rotor and upper and lower balance blocks; a pump assembly is arranged in the low-pressure chamber, the pump assembly comprises a crankshaft, a crankshaft shell, a cylinder, a piston, a sliding vane and a bearing, the piston, the sliding vane, the cylinder, the bearing and the crankshaft shell cooperatively form a compression chamber, the cylinder is provided with a sliding vane groove, the sliding vane is arranged in the sliding vane groove, and the sliding vane cooperates with the piston to divide the compression chamber into a low-pressure area and a high-pressure area; the crankshaft shell is provided with a low-pressure air inlet port, a position of the low-pressure air inlet port corresponds to a position of the low-pressure air inlet component, which can directly introduce a low-pressure refrigerant to the rotor and the stator in the crankshaft shell to directly cool the rotor and the stator. Meanwhile, the motor assembly can heat and vaporize the low-pressure refrigerant that is not completely vaporized, so as to increase the temperature of a gaseous refrigerant before compression, thereby improving the refrigeration coefficient and maximizing the effective energy utilization rate. The motor assembly and the pump assembly are arranged in the low-pressure chamber; the crankshaft and the piston are arranged in the cylinder. The cylinder, the bearing and the sliding vane are arranged in the low-pressure chamber, and the cylinder, the bearing and sliding vane are fully cooled to minimize thermal expansion and deformation. The piston and the crankshaft are arranged in the cylinder, so that internal heat cannot be effectively dissipated in time, obtaining a large thermal expansion and deformation, and thus effectively strengthen sealing performance between the cylinder and the piston and improving the compression effect on the refrigerant.

According to some embodiments of the disclosure, the pump assembly is further connected with an oil-gas separation assembly for separating a lubricating oil and a refrigerant, the oil-gas separation assembly comprises a chamber, several separation baffle for oil-gas separation, an oil-gas separation inlet port arranged on the chamber, an oil-gas separation exhaust port arranged on the chamber and several oil leakage hole arranged below the chamber, the separation baffle is arranged in the chamber, and the oil-gas separation exhaust port is connected with the cylinder air intake hole.

According to some embodiments of the disclosure, the separation baffle comprises several first separation baffle and several separation baffle arranged in the chamber, the several first separation baffle is arranged at a lower side of the chamber and the several separation baffle is arranged at an upper side of the chamber, and the first separation baffles and the second separation baffles are staggered in the chamber.

According to some embodiments of the disclosure, several mounting buckle is arranged above the chamber, the crankshaft shell is provided with a mounting hole corresponding to the mounting buckle, and the oil-gas separation assembly and the crankshaft shell are fixed through cooperation of the mounting buckle and the mounting hole.

According to some embodiments of the disclosure, the pump assembly further comprises a sound attenuation end cover, the sound attenuation end cover is arranged on the bearing, the sound attenuation end cover is communicated with the high-pressure air exhaust port, the sound attenuation end cover is provided with an air exhaust chamber, the air exhaust chamber cooperates with the bearing to form a high-pressure chamber, and several division plate is arranged in the air exhaust chamber, a sound attenuation notch is formed between the division plate and the sound attenuation end cover, and the sound attenuation end cover is further provided with an end cover air exhaust port for exhausting.

According to some embodiments of the disclosure, the bearing is arranged between the cylinder and the sound attenuation end cover, the bearing cooperates with the cylinder to form a compression chamber, the bearing cooperates with the sound attenuation end cover to form a high-pressure chamber, the bearing is provided with several deformation groove and an exhaust valve communicating with the high-pressure chamber and the compression chamber, and the deformation groove is arranged at one side of the bearing far away from the cylinder, so that a thin wall is formed between the bearing and the cylinder.

According to some embodiments of the disclosure, the high-pressure air exhaust component comprises an air exhaust outlet arranged on the housing, an air exhaust mounting portion arranged on one side of the air exhaust outlet, an air exhaust connector arranged on the air exhaust outlet, a high-pressure copper pipe mounted on the air exhaust mounting portion, and a sealing element for fixedly connecting the high-pressure copper pipe with the air exhaust mounting portion, the sealing element is integrally formed with the high-pressure copper pipe, the air exhaust mounting portion is provided with a vent groove connected with the air exhaust outlet, and the sealing element comprises a sealing head and a connecting bolt, and the sealing head cooperates with the connecting bolt to fix the high-pressure copper pipe on the air exhaust mounting portion.

According to some embodiments of the disclosure, the high-pressure copper pipe is arranged in a spiral shape, the high-pressure copper pipe is connected with the high-pressure air exhaust port, the high-pressure copper pipe is arranged around the pump assembly to realize intermediate cooling of the high-pressure refrigerant.

According to some embodiments of the disclosure, the crankshaft comprises a shaft body and an eccentric section arranged on the shaft body, the eccentric section is arranged in the piston, the eccentric section is provided with an elastic deformation portion, and the elastic deformation portion comprises a convex portion protruding outwards and a deformation hole arranged in a side wall of the convex portion.

According to some embodiments of the disclosure, a connecting component is further arranged between the pump assembly and the housing, a plurality of mounting lug bosses are arranged in the housing, a plurality of mounting positions are arranged on the pump assembly, the plurality of mounting lug bosses are uniformly distributed on the housing, and the connecting component is arranged between the mounting lug boss and the mounting position to connect the pump assembly and the housing.

According to some embodiments of the disclosure, a bottom portion of the housing is sunken downwards to form an oil storage tank, and the lubricating oil is arranged in the oil storage tank.

According to some embodiments of the disclosure, an electronic control mounting portion is further arranged outside the housing, the electronic control mounting portion is integrally formed with the housing, the electronic control mounting portion cooperates with the housing to form an electronic control mounting chamber, and a bottom portion of the electronic control mounting chamber is provided with a mounting hole position for mounting an electronic control component.

According to some embodiments of the disclosure, one side of the crankshaft matched with the crankshaft shell is provided with a plurality of oil slinger grooves, and the plurality of oil slinger grooves are uniformly distributed on the crankshaft in a radial manner.

An inner end face of the piston is provided with an end face chamfer, the crankshaft shell is provided with an oil inlet groove, the sliding vane is provided with an oil storage groove, and one side of the sliding vane matched with the crankshaft shell is provided with an oil receiving chamfer.

The air conditioner according to an embodiment in a second aspect of the disclosure comprises the rotary compressor with a low-pressure chamber according to the embodiment in the first aspect of the disclosure.

The air conditioner according to the second aspect embodiment of the disclosure has at least the following beneficial effects. The air conditioner adopts the rotary compressor with a low-pressure chamber according to the embodiment in the first aspect, which can cool the motor assembly. Meanwhile, the motor assembly can heat and vaporize the low-pressure refrigerant that is not completely vaporized, so as to increase the temperature of a gaseous refrigerant before compression, thereby improving the refrigeration coefficient and maximizing the effective energy utilization rate. The pump assembly is placed in the low-pressure chamber, which can effectively strengthen sealing performance between the cylinder and the piston and improve the compression effect on the refrigerant.

Additional aspects and advantages of the present disclosure will be given in part in the following description, and will become apparent in part from the following description, or will be learned through the practice of the present disclosure.

BRIEF DESCRIPTION OF THE DRAWINGS

The above and/or additional aspects and advantages of the present disclosure will be more apparent from the following description of the embodiments in conjunction with the accompanying drawings, wherein.

DETAILED DESCRIPTION

Figure 1:
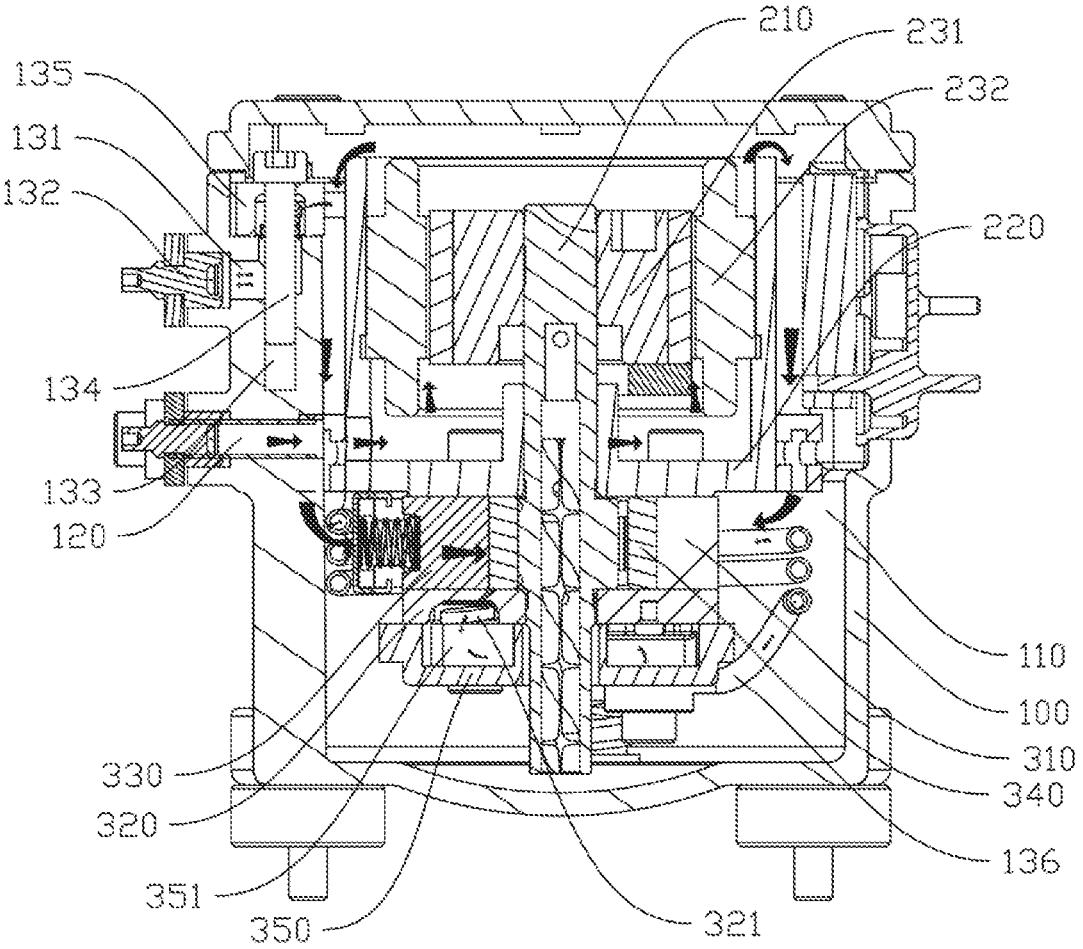
FIG. 1 is a sectional view of a rotary compressor with a low-pressure chamber according to an embodiment of the disclosure.

The embodiments of the present disclosure will be described in detail hereinafter. Examples of the embodiments are shown in the drawings. The same or similar reference numerals throughout the drawings denote the same or similar elements or elements having the same or similar functions. The embodiments described below by reference to the drawings are exemplary and are intended only to explain the present disclosure and are not to be construed as limiting the present disclosure.

In the description of the present disclosure, it should be understood that the orientation or positional relationship indicated by the terms upper, lower, front, back, left, right, inner, and outer is based on the orientation or positional relationship shown in the drawings, only for the convenience of describing the present disclosure and simplifying the description, and does not indicate or imply that the indicated device or element must have a specific orientation, or be constructed and operated in a specific orientation. Therefore, the terms should not be construed as limiting the present disclosure.

In the description of the present disclosure, the meaning of several refers to one or more, and the meaning of multiple refers to be two or more. The meanings of greater than, less than, more than, etc., are understood as not including the following number, while the meanings of above, below, within, etc., are understood as including the following number. If first and second are described, the descriptions are used for the purpose of distinguishing the technical features only, and cannot be understood as indicating or implying relative importance, or implicitly indicating the number of technical features indicated thereby, or implicitly indicating the order of technical features indicated thereby.

In the description of the present disclosure, unless otherwise explicitly defined, words such as setting, mounting and connecting should be understood in a broad sense, and those having ordinary skills in the art can reasonably determine the specific meanings of the above words in the present disclosure in combination with the specific contents of the technical solutions.

Figure 2:
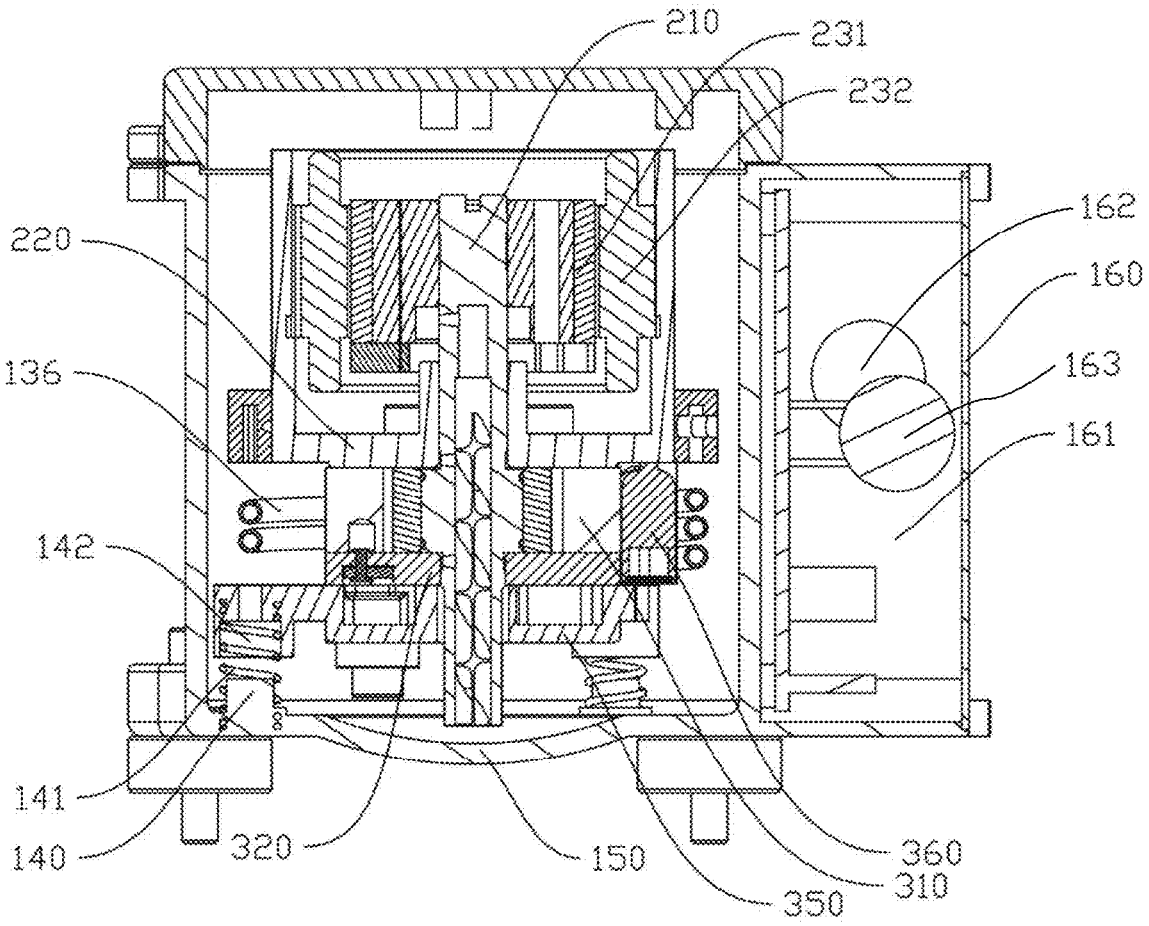
FIG. 2 is a sectional view of the rotary compressor with a low-pressure chamber shown in FIG. 1 from another perspective.
Figure 3:
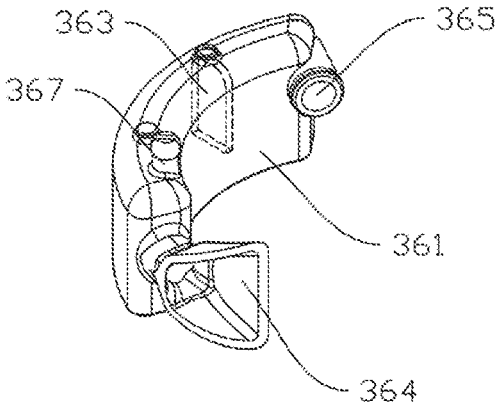
FIG. 3 is a structural schematic diagram of an oil-gas separation assembly shown in FIG. 1.
Figure 4:
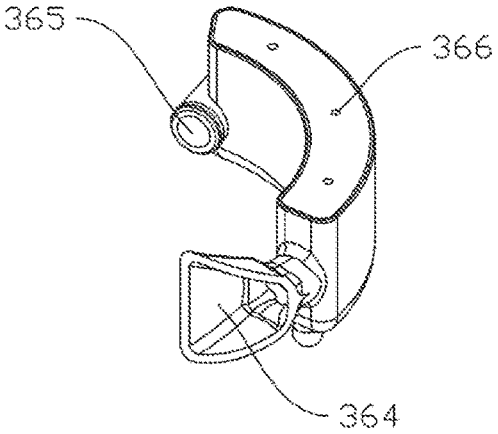
FIG. 4 is a structural schematic diagram of the oil-gas separation assembly shown in FIG. 3 from another perspective.
Figure 5:
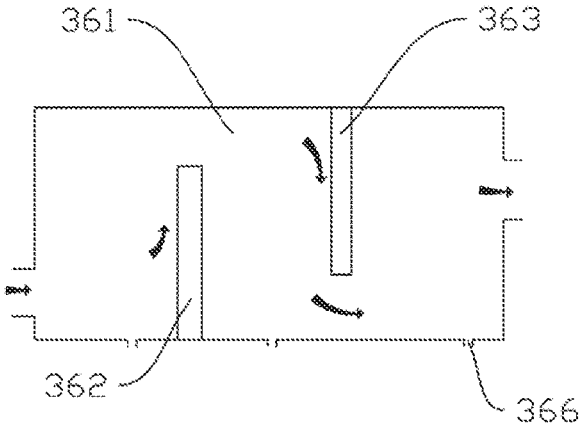
FIG. 5 is a structural schematic diagram showing oil-gas separation of the oil-gas separation assembly shown in FIG. 3.
Figure 6:
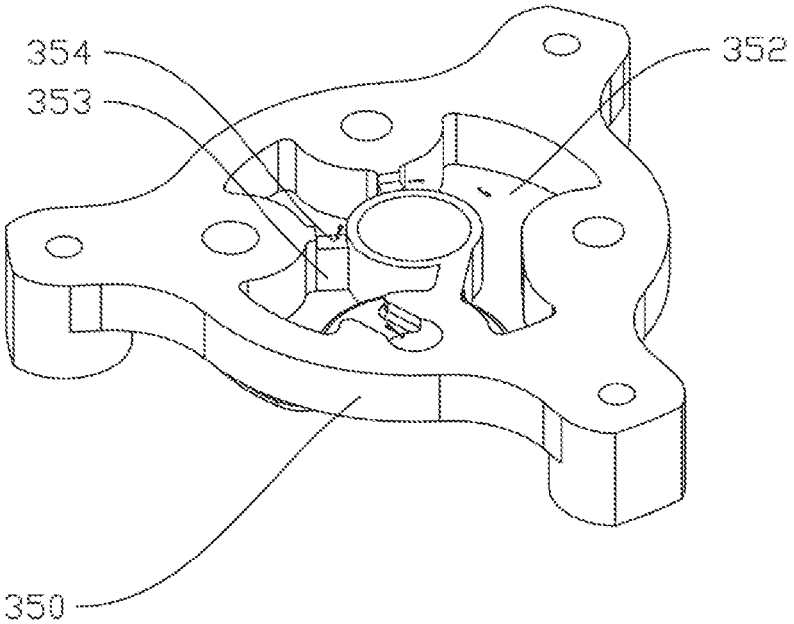
FIG. 6 is a structural schematic diagram of a sound attenuation end cover shown in FIG. 1.
Figure 7:
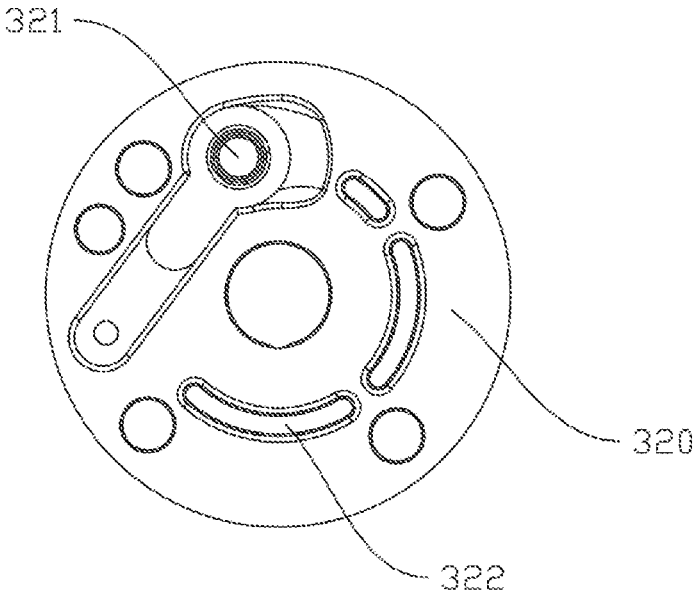
FIG. 7 is a structural schematic diagram of a bearing shown in FIG. 1.
Figure 8:
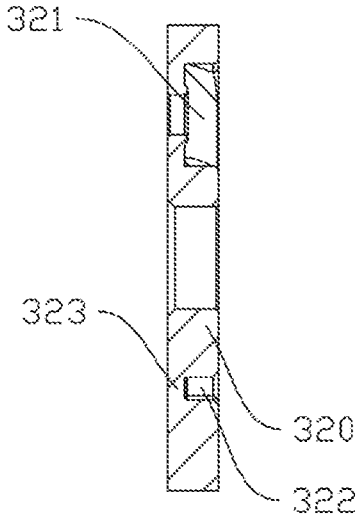
FIG. 8 is a sectional view of the bearing shown in FIG. 7.
Figure 9:
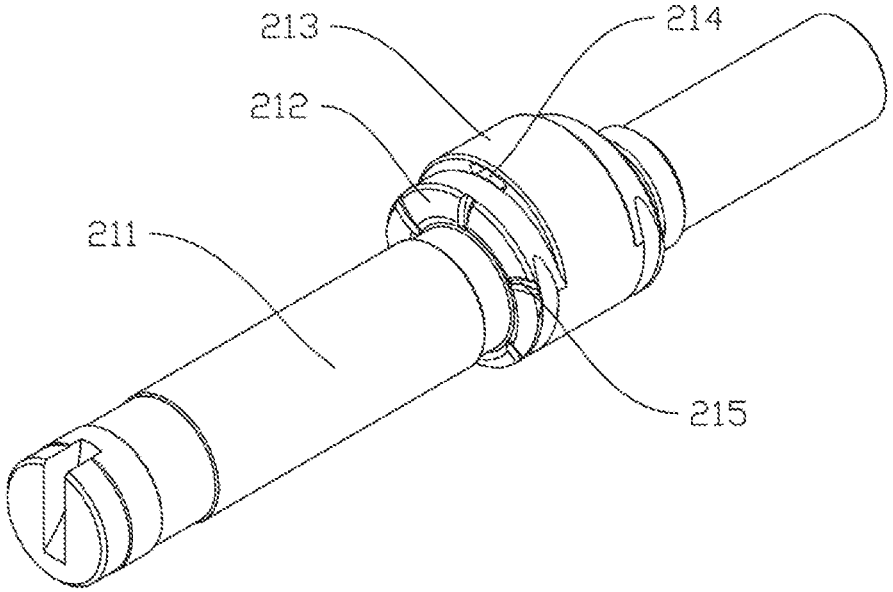
FIG. 9 is a structural schematic diagram of a crankshaft shown in FIG. 1.
Figure 10:
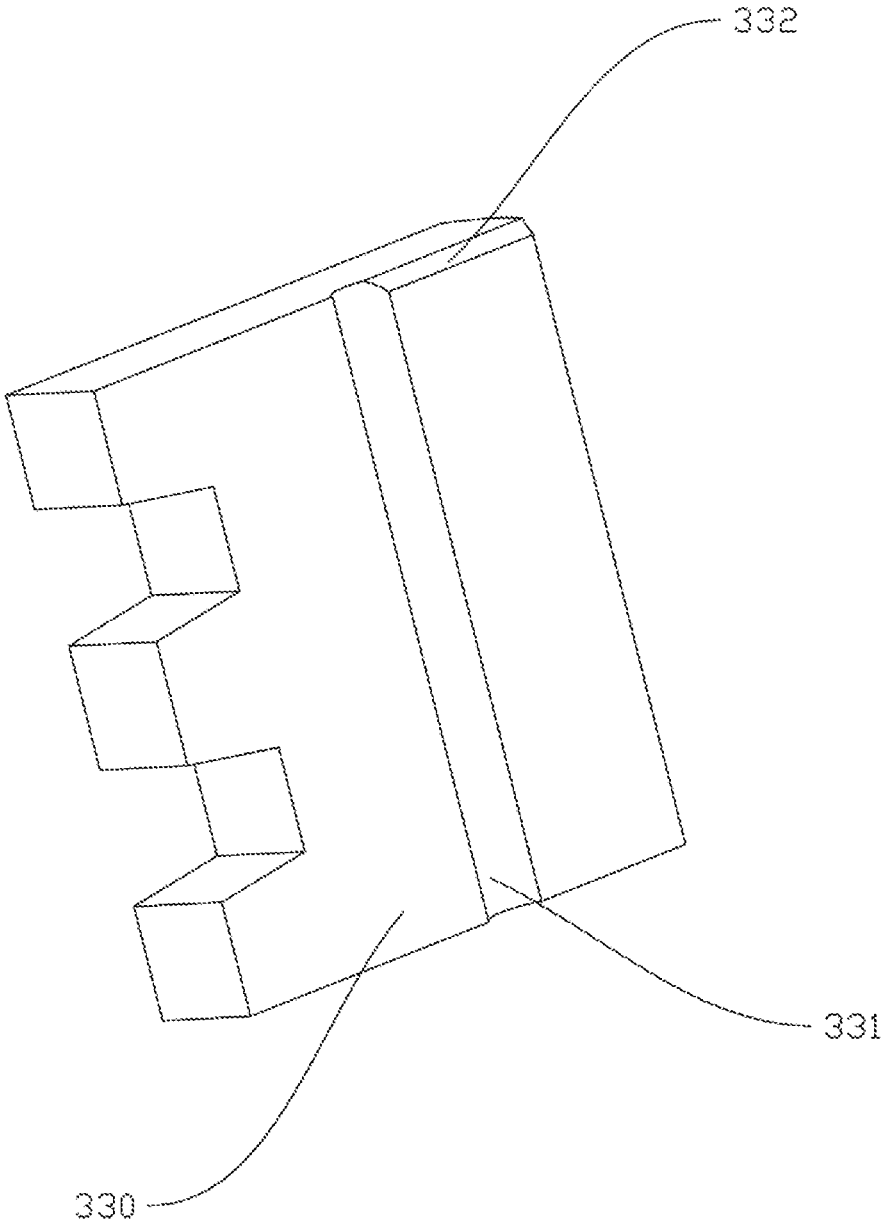
FIG. 10 is a structural schematic diagram of a sliding vane shown in FIG. 1.
Figure 11:
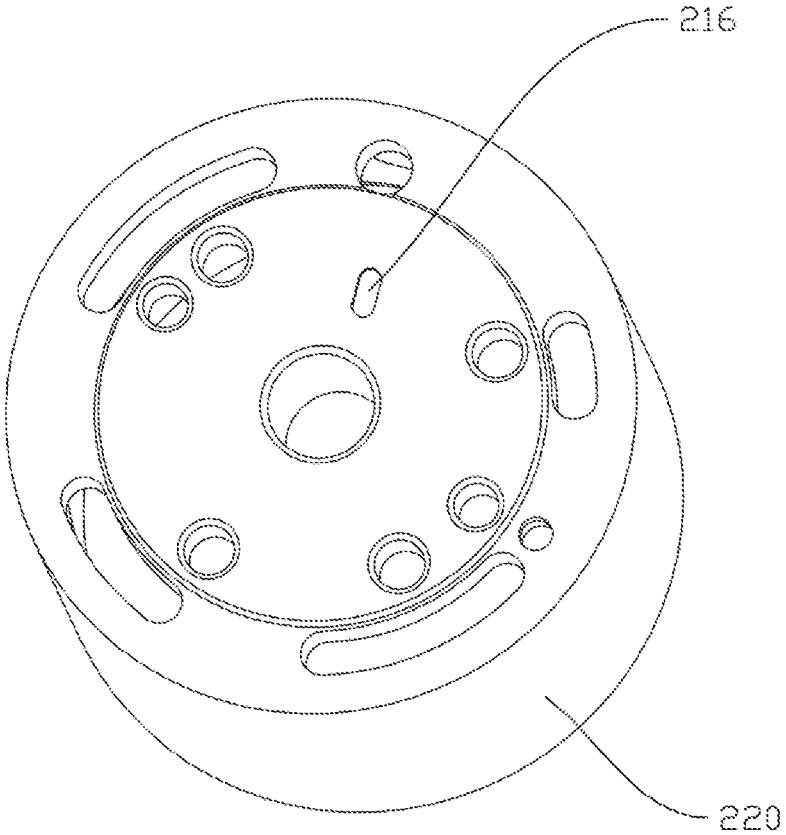
FIG. 11 is a structural schematic diagram of a crankshaft shell shown in FIG. 1.
Figure 12:
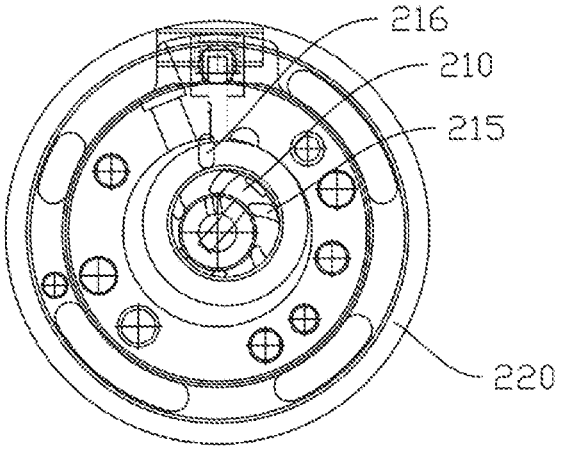
FIG. 12 is a schematic diagram of a working state of a pump assembly according to an embodiment of the disclosure.
Figure 13:
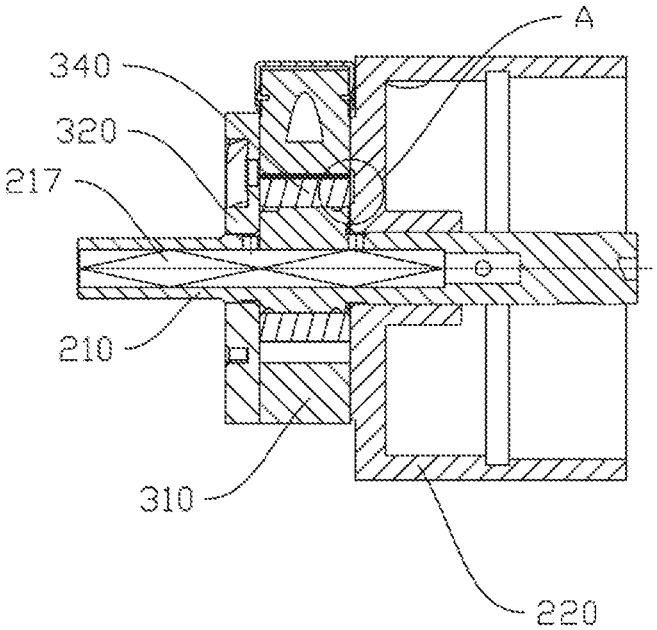
FIG. 13 is a sectional view of the pump assembly shown in FIG. 12.
Figure 14:
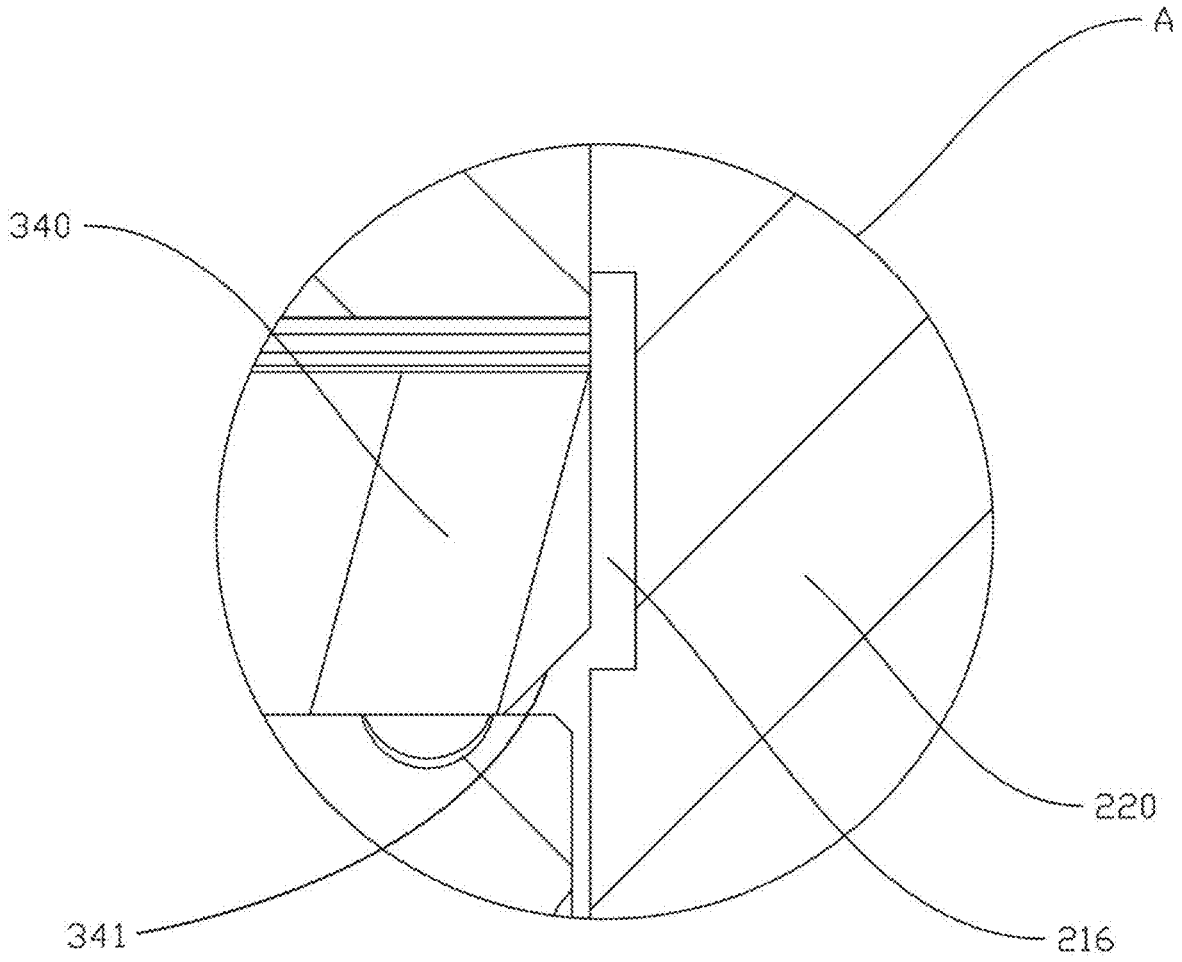
FIG. 14 is an enlarged view of the area A in FIG. 13.

A rotary compressor with a low-pressure chamber according to an embodiment of the disclosure is described with reference to FIG. 1 to FIG. 14 below.

The rotary compressor with a low-pressure chamber according to an embodiment of the disclosure, as shown in FIG. 1 to FIG. 14, comprises a housing 100, a motor assembly and a pump assembly. A low-pressure chamber 110 filled with a low-pressure refrigerant is arranged in the housing 100. The housing 100 is provided with a low-pressure air inlet component 120 and a high-pressure air exhaust component, the low-pressure air inlet component 120 is used for introducing the low-pressure refrigerant, the high-pressure air exhaust component is used for discharging a high-pressure refrigerant, the low-pressure refrigerant enters the housing 100 through the low-pressure air inlet component 120 from the outside of the housing 100 to cool the pump assembly in the housing 100. The low-pressure refrigerant is compressed to be transformed into a high-pressure refrigerant after entering the pump assembly, and the high-pressure refrigerant is discharged from the housing 100 through the high-pressure air exhaust component. The pump assembly is arranged in the low-pressure chamber 110, the motor assembly is arranged in the low-pressure chamber 110, the motor assembly comprises a stator, a rotor and upper and lower balance blocks. The pump assembly is arranged in the low-pressure chamber 110, the pump assembly comprises a crankshaft 210, a crankshaft shell 220, a cylinder 310, a piston 340, a sliding vane 330 and a bearing 320. The piston 340, the sliding vane 330, the cylinder 310, the bearing 320 and the crankshaft shell 220 cooperatively form a compression chamber. The cylinder 310 is provided with a sliding vane groove, the sliding vane 330 is arranged in the sliding vane groove, and the sliding vane 330 cooperates with the piston 340 to divide the compression chamber into a low-pressure area and a high-pressure area. The crankshaft shell 220 is arranged around the crankshaft 210. The stator and the rotor are arranged in the crankshaft shell 220, the crankshaft shell 220 is provided with a low-pressure air inlet port, the pump assembly is provided with a cylinder air intake hole and a high-pressure air exhaust port. A position of the low-pressure air inlet port corresponds to a position of the low-pressure air inlet component 120. The high-pressure air exhaust port is connected with the high-pressure air exhaust component. The position of the low-pressure air inlet port corresponds to the position of the low-pressure air inlet component 120. The low-pressure refrigerant enters the housing 100 through the low-pressure air inlet component 120, the low-pressure refrigerant in the housing 100 enters the pump assembly through the low-pressure air inlet port to cool the motor assembly of the pump assembly. To be specific, the low-pressure refrigerant passes through the low-pressure air inlet port to directly cool the stator and the rotor to ensure a service life of the motor assembly. In a cooling process, the motor assembly may heat and vaporize the low-pressure refrigerant that is not completely vaporized, so that the low-pressure refrigerant is completely vaporized, and the refrigerant is able to be completely sucked into the pump assembly to increase the temperature of a gaseous refrigerant before compression, thereby improving the refrigeration coefficient and maximizing the effective energy utilization rate. The pump assembly comprises the crankshaft 210, the crankshaft shell 220, the cylinder 310, the piston 340, the sliding vane 330 and the bearing 320, the crankshaft 210 and the piston 340 are arranged in the cylinder 310, the cylinder 310, the bearing 320 and the sliding vane 330 are arranged in the low-pressure chamber 110, the low-pressure chamber 110 is filled with the low-pressure refrigerant, the low-pressure refrigerant may cool the cylinder 310, the bearing 320 and the sliding vane 330 in the low-pressure chamber 110, so that the cylinder 310, the bearing 320 and the sliding vane 330 can be fully cooled to minimize thermal expansion and deformation. The piston 340 and the crankshaft 210 are arranged in the cylinder 310, so that internal heat cannot be effectively dissipated in time, obtaining a large thermal expansion and deformation, and thus effectively strengthening sealing performance between the cylinder 310 and the piston 340 and improving the compression effect on the refrigerant.

The low-pressure refrigerant enters the low-pressure chamber 110 of the housing 100 through the low-pressure air inlet component 120, the gaseous refrigerant in the low-pressure chamber 110 will be mixed with part of the lubricating oil in the housing 100. In order to ensure maximum utilization of a refrigerant compression space each time, oil mist needs to be separated from the gaseous refrigerant as much as possible before the gaseous refrigerant is sucked into the cylinder 310 for compression. The pump assembly is provided with an oil-gas separation assembly 360, which can effectively separate the oil mist from the gaseous refrigerant, so that the oil mist is settled and separated and discharged to an oil tank, ensuring both the lubricating oil and the refrigerant can be fully utilized.

In some embodiments, the pump assembly is further connected with an oil-gas separation assembly 360 for separating the lubricating oil from the refrigerant, the oil-gas separation assembly 360 comprises a chamber 361, several separation baffle for oil-gas separation, an oil-gas separation inlet port 364 arranged on the chamber 361, an oil-gas separation exhaust port 365 arranged on the chamber 361 and several oil leakage hole 366 arranged below the chamber 361. The separation baffle is arranged in the chamber 361, and the oil-gas separation exhaust port 365 is connected with an air inlet port of the cylinder 310. The oil-gas separation assembly 360 comprises the chamber 361, the separation baffle, the oil-gas separation inlet port 364, the oil-gas separation exhaust port 365 and the oil leakage holes 366, an oil-gas mixture enters the chamber 361 from the oil-gas separation inlet port 364, several separation baffle is arranged in the chamber 361, so that the separation baffle can obstruct the oil mist. The oil leakage hole 366 is arranged below the chamber 361, so that the oil mist can be obstructed and settled to outflow from the oil leakage hole 366 and flow back to the oil tank. The oil-gas separation exhaust port 365 is connected with the air inlet port of the cylinder 310, the gaseous refrigerant separated from the oil mist is flowed into the air inlet port of the cylinder 310 from the oil-gas separation exhaust port 365, and finally sucked into the cylinder 310 to be compressed.

To be specific, in some embodiments, the separation baffle comprises several first separation baffle 362 and several separation baffle 363 arranged in the chamber 361, the several first separation baffle 362 is arranged at a lower side of the chamber 361 and the several second separation baffle 363 is arranged at an upper side of the chamber 361, and the first separation baffle 362 and the second separation baffle 363 are staggered in the chamber 361. By arranging the first separation baffle 362 at the upper side of the chamber 361, and the second separation baffle 363 at the lower side of the chamber 361, and staggering the first separation baffle 362 and the second separation baffle 363 alternately up and down, the oil mist blocking effect can be enhanced to ensure better separation effect. It may be understood that several first separation baffle 362 is provided and several second separation baffle 363 is provided, and in actual production, the number of the first separation baffles 362 and the second separation baffles 363 may be adjusted as required. The greater the number of the first separation baffles 362 and the second separation baffles 363, the better the blocking and separation effect of the oil mist.

In some embodiments, several mounting buckle 367 is arranged above the chamber 361, the crankshaft shell 220 is provided with a mounting hole corresponding to the mounting buckle 367, and the oil-gas separation assembly and the crankshaft shell 220 are fixed through cooperation of the mounting buckle 367 and the mounting hole. The cylinder 310 cooperates with the crankshaft shell 220, the oil-gas separation assembly 360 is arranged around the cylinder 310, the oil-gas separation exhaust port 365 of the oil-gas separation assembly 360 is connected with the air inlet port of the cylinder 310. To be specific, the chamber 361 is provided with several mounting buckle 367, the crankshaft shell 220 is provided with a mounting hole corresponding to the mounting buckle 367, the oil-gas separation assembly and the crankshaft shell 220 are fixed through cooperation of the mounting buckle 367 and the mounting hole, thus realizing fixation of the oil-gas separation assembly. Several mounting buckles 367 are provided, and the number of mounting holes corresponds to the number of mounting buckles 367. According to actual mounting needs, the number of mounting buckles 367 and the number of mounting holes may be set to one, two, three or more. The greater the number of mounting buckles 367 and the number of mounting holes are, the more stable connection between the oil-gas separation assembly and the crankshaft shell 220 will be. It may be understood that in some other embodiments, the mounting hole is arranged on the chamber 361, and the mounting buckle 367 is arranged on the crankshaft shell 220, which can also realize assembly and fixation of the oil-gas separation assembly 360 and the crankshaft shell 220. It should be noted that the chamber 361 may also be fixed on the crankshaft shell 220 in other ways such as threaded connection, which is also within the protection scope of the disclosure. Moreover, the chamber 361 of the oil-gas separation assembly 360 is arranged in an annular shape, and the annular chamber 361 can cover the cylinder 310 and increase a moving distance of the oil-gas mixture in the chamber 361, realizing better separation effect.

In some embodiments, the pump assembly further comprises a sound attenuation end cover 350, the sound attenuation end cover 350 is arranged on the bearing 320, the sound attenuation end cover 350 is communicated with the high-pressure air exhaust port, the sound attenuation end cover 350 cooperates with the bearing 320 to form a high-pressure cavity 351, the sound attenuation end cover 350 is provided with an air exhaust chamber 352, and several division plate 353 is arranged in the air exhaust chamber 352, a sound attenuation notch 354 is formed between the division plate 353 and the sound attenuation end cover 350, and the sound attenuation end cover 350 is also provided with an end cover air exhaust port for exhausting. The pump assembly is provided with the sound attenuation end cover 350 for sealing, the sound attenuation end cover 350 is arranged on the bearing 320, the sound attenuation end cover 350 is provided with the air exhaust chamber 352, the air exhaust chamber 352 cooperates with the bearing 320 to form the high-pressure chamber 351, the compressed high-pressure refrigerant flows into the high-pressure chamber 351, and the high-pressure refrigerant flows in the air exhaust chamber 352, and several division plate 353 is arranged in the air exhaust chamber 352, the sound attenuation notch 354 is formed between the division plate 353 and the sound attenuation end cover 350, the several division plate 353 divides the air exhaust chamber 352 into a plurality of different chambers, and the high-pressure refrigerant flows among the different chambers through the sound attenuation notch 354, and finally is discharged from the air exhaust port of the end cover. Cross-sectional areas of the sound attenuation notch 354 and the air exhaust chamber 352 are different. The high-pressure refrigerant passes through the sound attenuation notch 354 with a smaller cross-sectional area and enters the air exhaust chamber 352 with a larger cross-sectional area, which can effectively reduce noises generated when the high-pressure refrigerant flows through the sound attenuation end cover 350, realizing functions of sound attenuation and noise reduction. It should be understood that several division plate 353 may be provided, and several division plate 353 arranged in the air exhaust chamber 352 can divide the air exhaust chamber 352 into the plurality of chambers, thereby improving the functions of sound attenuation and noise reduction.

In some embodiments, the bearing 320 is arranged between the cylinder 310 and the sound attenuation end cover 350, the bearing 320 cooperates with the cylinder 310 to form a compression chamber, the bearing 320 cooperates with the sound attenuation end cover 350 to form a high-pressure chamber 351, the bearing 320 is provided with several deformation groove 322 and an exhaust valve 321 communicating with the high-pressure chamber 351 and the compression chamber, and the deformation groove 322 is arranged at one side of the bearing 320 far away from the cylinder 310, so that a thin wall 323 is formed between the bearing 320 and the cylinder 310. Two surfaces of the bearing 320 in contact with the cylinder 310 and the sound attenuation end cover 350 are set as fine grinding surfaces, so as to facilitate the cooperation with the cylinder 310 and the sound attenuation end cover 350 and enhance the sealing performance. The bearing 320 is arranged between the cylinder 310 and the sound attenuation end cover 350, one face of the bearing 320 cooperates with the cylinder 310 to form a compression chamber, and the other face of the bearing 320 cooperates with the sound attenuation end cover 350 to form a high-pressure chamber 351, the bearing 320 is provided with an air exhaust valve 321 communicating the compression chamber with the high-pressure chamber 351, the low-pressure refrigerant enters the compression chamber and is compressed as a high-pressure refrigerant, and the high-pressure refrigerant enters the high-pressure chamber 351 through the air exhaust valve 321, and finally is discharged from the high-pressure chamber 351. The bearing 320 is provided with several deformation groove 322 which is arranged at one side of the bearing 320 far away from the cylinder 310, and a thin wall 323 is formed between the bearing 320 and the cylinder 310 through arrangement of the deformation groove 322. When the high-pressure refrigerant enters the high-pressure chamber 351, the high-pressure refrigerant exerts a pressure on the bearing 320 at the side where the deformation groove 322 is located, and the thin wall 323 will be deformed to the side with a lower pressure when being subjected to a high pressure, that is, the thin wall 323 of the bearing 320 will be deformed and abutted against the cylinder 310 and the piston 340 after receiving a pressure from the high-pressure refrigerant, so as to minimize a mating clearance between the bearing 320 and an end face of the piston 340 and enhance the sealing effect of the bearing 320 on the cylinder 310 and the piston 340. It should be understood that positions and numbers of the deformation groove 322 and the thin walls 323 may be set according to the required sealing effect, which shall fall within the protection scope of the disclosure.

In some embodiments, the high-pressure air exhaust component comprises an air exhaust outlet 131 arranged on the housing 100, an air exhaust mounting portion arranged on one side of the air exhaust outlet 131, an air exhaust connector 132 arranged on the air exhaust outlet 131, a high-pressure copper pipe 136 mounted on the air exhaust mounting portion, and a sealing element for fixedly connecting the high-pressure copper pipe 136 with the air exhaust mounting portion, the sealing element is integrally formed with the high-pressure copper pipe 136, the air exhaust mounting portion is provided with a vent groove 133 connected with the air exhaust outlet 131, and the sealing element comprises a sealing head 135 and a connecting bolt 134, and the sealing head 135 cooperates with the connecting bolt 134 to fix the high-pressure copper pipe 136 on the air exhaust mounting portion. The housing 100 is provided with the air exhaust outlet 131, the air exhaust connector 132 is arranged at the air exhaust outlet 131, the air exhaust connector 132 is used for connecting the external air exhaust pipe to discharge the high-pressure refrigerant. One side of the air exhaust outlet 131 is provided with the air exhaust mounting portion, the air exhaust mounting portion is internally hollowed to form the vent groove 133, the sealing element seals the high-pressure copper pipe 136 in the vent groove 133, so as to realize the connection and sealing between the high-pressure copper pipe 136 and the vent groove 133. The sealing element comprises the sealing head 135 and the connecting bolt 134, and the connecting bolt 134 cooperates with the sealing head 135 to seal and mount the high-pressure copper pipe 136 on the air exhaust mounting portion. The mounting mode of threaded connection is convenient for assembly and is suitable for the assembly work of an assembly line. It should be noted that the high-pressure copper pipe 136 may also be fixedly connected with the air exhaust mounting portion by other connecting methods such as welding. Moreover, in some embodiments, the high-pressure copper pipe 136 is arranged in a spiral shape, the high-pressure copper pipe 136 is connected with the high-pressure air exhaust port, the high-pressure copper pipe 136 is arranged around the pump assembly to realize intermediate cooling of the high-pressure refrigerant. The spiral high-pressure copper pipe 136 is arranged within the low-pressure chamber 110, and this spiral arrangement of the spiral high-pressure copper pipe 136 acts as a buffer against bending fatigue, ensuring a more stable connection. The high-pressure copper pipe can serves as an intercooler to perform intermediate cooling for the high-pressure refrigerant, providing a reheating function. At the same time, it helps to reduce the pressure on the external condenser and can preheat the gas returning from the evaporator, increasing the intake temperature and improving the refrigeration coefficient.

In some embodiments, the crankshaft 210 comprises a shaft body 211 and an eccentric section 212 arranged on the shaft body 211, the eccentric section 212 is arranged in the piston 340, the eccentric section 212 is provided with an elastic deformation portion, and the elastic deformation portion comprises a convex portion 213 protruding outwards and a deformation hole 214 arranged in a side wall of the convex portion 213. The eccentric section 212 of the crankshaft 210 is arranged in the piston 340, the piston 340 is arranged between the eccentric section 212 and the cylinder 310, the eccentric section 212 is provided with the elastic deformation portion, the elastic deformation portion comprises the convex portion 213 and the deformation hole 214 arranged on a side wall of the convex portion 213, the convex portion 213 is a highest point of the eccentric section 212, and the convex portion 213 protrudes outwards to engaged with an inner ring surface of the piston 340 to drive the piston 340 to rotate and induce an outer ring surface of the piston 340 to seal with an inner surface of the cylinder 310 and to compress the refrigerant. When there is a large gap between the piston 340 and the cylinder 310, the deformation hole 214 with elastic deformation ability may elastically deform outward to support the piston 340, so as to reduce the gap between the outer ring surface of the piston 340 and the inner surface of the cylinder 310. When no gap or a small gap exists between the piston 340 and the cylinder 310, the deformation hole 214 may be deformed inward under a pressure to prevent the outer ring surface of the piston 340 and the inner surface of the cylinder 310 from being stuck during operation. The elastic deformation portion can reduce the gap between the piston 340 and the cylinder 310, improving the sealing effect, thereby improving the compression effect.

In some embodiments, a connecting component 141 is further arranged between the pump assembly and the housing 100, a plurality of mounting lug bosses 140 are arranged in the housing 100, a plurality of mounting positions 142 are arranged on the pump assembly, the plurality of mounting lug bosses 140 are uniformly distributed on the housing 100, and the connecting component 141 is arranged between the mounting lug boss 140 and the mounting position 142 to connect the pump assembly and the housing 100. The plurality of mounting lug bosses 140 are arranged in the housing 100, and the plurality of mounting positions 142 are arranged on the pump, positions and numbers of the mounting lug bosses 140 correspond to positions and numbers of the mounting positions 142, and the connecting portions are arranged between the mounting lug bosses 140 and the mounting positions 142 to connect the pump assembly and the housing 100. It may be understood that the plurality of mounting bosses 140 and the plurality of mounting positions 142 are provided, which are uniformly arranged around the crankshaft 210, so that the pump assembly can be fixed from a plurality of positions, improving the fixation for the pump assembly. To be specific, in some embodiments, the connecting portion 141 is set as an elastic connector such as a support spring or a gas spring, and the pump assembly and the housing 100 are connected by the elastic connector, the elastic connector can act as a buffer against vibration, effectively avoid vibration of the compressor from being directly transmitted to the housing to generate noises during high-speed rotation, and ensure stable operation of the compressor. Moreover, in some embodiments, the connecting portion 141 is provided as a fixed connector. Connecting the compressor pump assembly with the housing 100 by using the fixed connector can ensure that a distance between the compressor pump and the housing 100 is relatively fixed preventing any collisions, and ensure that a relative position of the compressor pump assembly is fixed without shaking in various states, so that the compressor pump is suitable for use in equipment that needs displacement and has a large range of displacement.

In some embodiments, a bottom portion of the housing 100 is sunken downwards to form an oil storage tank 150, and the lubricating oil is arranged in the oil storage tank 150. The bottom portion of the housing 100 is provided with the oil storage tank 150, and the oil storage tank 150 may store the lubricating oil. The lubricating oil can play a role in providing lubrication, and the lubricating oil forms a protective film between the components to avoid direct contact between the components, thus buffering a friction force, reducing wear and prolonging the service life of the pump assembly.

In some embodiments, an electronic control mounting portion 160 is further arranged outside the housing 100, the electronic control mounting portion 160 is integrally formed with the housing 100, the electronic control mounting portion 160 cooperates with the housing 100 to form an electronic control mounting chamber 161, and a bottom portion of the electronic control mounting chamber 161 is provided with a mounting hole position for mounting an electronic control component. The electronic control mounting portion 160 is further arranged outside the housing 100, the electronic control mounting portion 160 is integrally formed with the housing 100, the low-pressure chamber 110 is arranged in the housing 100, the electronic control mounting chamber 161 of the electronic control mounting portion 160 is separated from the low-pressure chamber 110 of the housing 100 by only the thickness of the housing 100, so that the heat in the electronic control mounting chamber 161 can be quickly and effectively conducted to the low-temperature refrigerant in the low-pressure chamber 110, and the low-temperature refrigerant can cool and dissipate heat in the electronic control mounting chamber 161, and the heat in the electronic control mounting chamber 161 can also promote the full evaporation of the refrigerant. In some embodiments, the housing 100 is made of aluminum alloy. The aluminum alloy has good thermal conductivity, which is beneficial to realize heat exchange between the electronic control mounting chamber 161 and the low-pressure chamber 110. The aluminum material is easy to process and shape, allowing for the desired form and structure at a relatively low manufacturing cost.

In some embodiments, one side of the crankshaft 210 close to the crankshaft shell 220 is provided with a plurality of oil slinger grooves 215, and the plurality of oil slinger grooves 215 are uniformly distributed on the crankshaft 210 in a radial manner. An inner end face of the piston 340 is provided with an end face chamfer, the crankshaft shell 220 is provided with an oil inlet groove 216, the sliding vane 330 is provided with an oil storage groove 331, and one side of the sliding vane 330 matched with the crankshaft shell 220 is provided with an oil receiving chamfer 332. The crankshaft 210 is provided with oil pumping blades 217. When the crankshaft 210 rotates, the lubricating oil in the oil storage tank 150 is pumped into a central inner hole of the crankshaft 210 by a helical structure of the oil pumping blades 217, and then thrown into portions needing lubrication by a centrifugal force through the oil slinger grooves 215 provided on the crankshaft 210, so as to realize the lubrication of the pump structure. It may be understood that the sliding vane 330 is provided with the oil storage tank 331 and the oil receiving chamfer 332, and the lubricating oil may enter the sliding vane through the oil receiving chamfer 332 to lubricate the sliding vane. The arrangement of the oil storage tank 331 can realize storage of the lubricating oil at a low-pressure side of the sliding vane 330 and discharge the lubricating oil into the low-pressure chamber 110 during linear movement of the sliding vane 330. To be specific, a bottom surface of the crankshaft shell 220 is provided with the oil inlet groove 216, and the piston 340 is provided with the end face chamfer. The oil slinger grooves 215, the oil inlet groove 216 and the end face chamfer cooperatively form an oil passage that may be automatically opened and closed according to a movement track of the rotor when rotating. The lubricating oil in the center of the crankshaft 210 is thrown out of the oil slinger grooves 215 under a centrifugal force. The piston 340 is arranged outside the crankshaft 210, the lubricating oil thrown out of the oil slinger grooves 215 enters the oil inlet groove 216 of the crankshaft shell 220 through the end face chamfer of the piston 340. The oil passage enables the lubricating oil to enter one side of the low-pressure chamber to fully lubricate the sliding vane 330 and the piston 340, and then the reciprocating motion of the sliding vane 330 can effectively discharge the lubricating oil from the low-pressure chamber 110 to flow back to the oil tank, thus realizing the lubricating oil circulation. It is ensured that the lubricating oil at each lubricating portion can circulate effectively between the working portion and the oil tank and form an effective sealing oil film in each assembly gap.

Lubricating oil circulation comprises a compressor chamber lubrication circuit, lubrication circuits at a low-pressure side of the sliding vane and upper and lower end surfaces of the piston, a lubrication circuit at a high-pressure side of the sliding vane, and a lubrication circuit between the bearing 320 and the crankshaft 220. The lubricating oil circulation is described as follows.

The compressor chamber lubrication circuit comprises the following steps.

First, the crankshaft 220 pumps oil. Under the action of centrifugal force, the lubricating oil at the center of the crankshaft 210 is thrown out from the oil slinger grooves 215. Through the action of centrifugal force, the lubricating oil enters an air intake low-pressure chamber between the cylinder 310 and an outer diameter of the piston 340 through the oil inlet groove 216. During the operation of the compressor, the lubricating oil transitions to the high-pressure compression chamber in the cylinder 310. There is a pressure difference between the high-pressure compression chamber and the external low-pressure chamber 110 and the lubricating oil is discharged to the low-pressure chamber 110 through this pressure difference. The lubricating oil discharged to the low-pressure chamber 110 falls into the oil storage tank 150 at the bottom of the housing. Finally, an auxiliary shaft oil hole of the crankshaft 220 draws oil from the oil storage tank 150 to realize pumping the oil and applying the oil for the crankshaft 220, and finally completing the lubricating oil circulation for the compressor chamber lubrication circuit.

The lubrication circuits at the low-pressure side of the sliding vane and the upper and lower end surfaces of the piston comprise the following steps.

Firstly, the crankshaft 220 pumps oil. The lubricating oil enters a low-pressure upper surface of the sliding vane 330 through the oil inlet groove 216. As the sliding vane 330 moves linearly, the lubricating oil enters the low-pressure side face of the sliding vane 330 from the low-pressure upper surface of the sliding vane 330. When the refrigerant is compressed to a medium pressure, the lubricating oil on the low-pressure side face is discharged back to the low-pressure chamber 110 due to the pressure difference with the external low pressure. The lubricating oil discharged into the low-pressure chamber 110 falls into the oil storage tank 150 at the bottom of the housing. Finally, the auxiliary shaft oil hole of the crankshaft 220 draws oil from the oil storage tank 150, thus realizing pumping the oil and applying the oil for the crankshaft 220, and finally completing the lubricating oil circulation for the lubrication circuits at the low-pressure side of the sliding vane and the upper and lower end surfaces of the piston.

The lubrication circuit at the high-pressure side of the sliding vane comprises the following steps.

Firstly, the crankshaft 220 pumps oil. The lubricating oil enters the high-pressure side surface of the sliding vane 330 through the oil inlet groove 216. When the refrigerant is compressed to a high pressure, the lubricating oil on the high-pressure side surface is discharged back to the low-pressure chamber 110 due to the pressure difference. The lubricating oil discharged to the low-pressure chamber 110 falls into the oil storage tank 150 at the bottom of the housing. Finally, the auxiliary shaft oil hole of the crankshaft 220 draws oil from the oil storage tank 150, thus realizing pumping the oil and applying the oil for the crankshaft 220, and finally completing the lubricating oil circulation for the lubrication circuit at the high-pressure side of the sliding vane.

The lubrication circuit between the bearing 320 and the crankshaft 220 comprises the following steps.

Firstly, the crankshaft 220 pumps oil. The lubricating oil enters the crankshaft 220 and the inner diameter of the bearing 320 through the oil hole of the crankshaft 220. The lubricating oil enters the low-pressure chamber 110, the lubrication oil discharged to the low-pressure chamber 110 falls into the oil storage tank 150 at the bottom of the housing. Finally, the auxiliary shaft oil hole of the crankshaft 220 draws oil from the oil storage tank 150, thus realizing pumping the oil and applying the oil for the crankshaft 220, and finally completing the lubricating oil circulation for the lubrication circuit between the bearing 320 and the crankshaft 220.

Through the above-mentioned lubricating oil circulation, the lubricating oil at each lubricating portion can be effectively circulated and lubricated between the working part and the oil storage tank 150, and form an effective sealing oil film in each assembly gap. This achieves the lubricating oil circulation, allowing the pump assembly to operate smoothly, thereby prolonging the service life of the pump assembly.

The disclosure further proposes an air conditioner, comprising the rotary compressor with a low-pressure chamber in the above-mentioned embodiments. By adopting the rotary compressor with a low-pressure chamber in the above-mentioned embodiments, the air conditioner can cool down the motor assembly. At the same time, the motor assembly can heat and vaporize the not fully vaporized low-pressure refrigerant, increasing the temperature of the gaseous refrigerant before compression. This in turn improves the refrigeration coefficient, maximizing the effective utilization of energy. By placing the pump inside the low-pressure chamber 110, the seal between the cylinder 310 and the piston 340 can also be effectively strengthened, enhancing the compression effect on the refrigerant.

The embodiments of the present disclosure are described in detail with reference to the drawings above, but the present disclosure is not limited to the above embodiments, and various changes may also be made within the knowledge scope of those of ordinary skills in the art without departing from the purpose of the present disclosure.

What is claimed is:

1. A rotary compressor with a low-pressure chamber, comprising:

a housing, wherein a low-pressure chamber filled with a low-pressure refrigerant is arranged in the housing, and the housing is provided with a low-pressure air inlet component for introducing the low-pressure refrigerant and a high-pressure air exhaust component for discharging a high-pressure refrigerant;

a motor assembly, wherein the motor assembly is arranged in the low-pressure chamber, and the motor assembly comprises a stator, a rotor and upper and lower balance blocks;

a pump assembly, wherein the pump assembly is arranged in the low-pressure chamber, the pump assembly comprises a crankshaft, a crankshaft shell, a cylinder, a piston, a sliding vane and a bearing; the piston, the sliding vane, the cylinder, the bearing and the crankshaft shell cooperatively form a compression chamber, the cylinder is provided with a sliding vane groove, the sliding vane is arranged in the sliding vane groove, and the sliding vane cooperates with the piston to divide the compression chamber into a low-pressure area and a high-pressure area; and wherein the crankshaft shell is provided with a low-pressure air inlet port, the pump assembly is provided with a cylinder air intake hole and a high-pressure air exhaust port, a position of the low-pressure air inlet port corresponds to a position of the low-pressure air inlet component, and the high-pressure air exhaust port is connected with the high-pressure air exhaust component;

wherein, the crankshaft and the piston are arranged in the cylinder, and the cylinder, the bearing and the sliding vane are arranged in the low-pressure chamber, wherein one side of the crankshaft matched with the crankshaft shell is provided with a plurality of oil slinger grooves, and the plurality of oil slinger grooves are uniformly distributed on the crankshaft in a radial manner, an inner end face of the piston is provided with an end face chamfer, the crankshaft shell is provided with an oil inlet groove, the sliding vane is provided with an oil storage groove, and one side of the sliding vane matched with the crankshaft shell is provided with an oil receiving chamfer.

2. The rotary compressor with a low-pressure chamber according to claim 1, wherein the pump assembly is further connected with an oil-gas separation assembly for separating a lubricating oil and a refrigerant, the oil-gas separation assembly comprises a chamber, several separation baffle for oil-gas separation, an oil-gas separation inlet port arranged on the chamber, an oil-gas separation exhaust port arranged on the chamber and several oil leakage hole arranged below the chamber, the separation baffle is arranged in the chamber, and the oil-gas separation exhaust port is connected with the cylinder air intake hole.

3. The rotary compressor with a low-pressure chamber according to claim 2, wherein the separation baffle comprises several first separation baffle and several second separation baffle arranged in the chamber, the several first separation baffle is arranged at a lower side of the chamber and the several second separation baffle is arranged at an upper side of the chamber, and the first separation baffle and the second separation baffle are staggered in the chamber.

4. The rotary compressor with a low-pressure chamber according to claim 2, wherein several mounting buckle is arranged above the chamber, the crankshaft shell is provided with a mounting hole corresponding to the mounting buckle, and the oil-gas separation assembly and the crankshaft shell are fixed through cooperation of the mounting buckle and the mounting hole.

5. The rotary compressor with a low-pressure chamber according to claim 1, wherein the pump assembly further comprises a sound attenuation end cover, the sound attenuation end cover is arranged on the bearing, the sound attenuation end cover is communicated with the high-pressure air exhaust port, the sound attenuation end cover is provided with an air exhaust chamber, the air exhaust chamber cooperates with the bearing to form a high-pressure chamber, and several division plate is arranged in the air exhaust chamber, a sound attenuation notch is formed between the division plate and the sound attenuation end cover, and the sound attenuation end cover is further provided with an end cover air exhaust port for exhausting.

6. The rotary compressor with a low-pressure chamber according to claim 5, wherein the bearing is arranged between the cylinder and the sound attenuation end cover, the bearing cooperates with the cylinder to form a compression chamber, the bearing cooperates with the sound attenuation end cover to form the high-pressure chamber, the bearing is provided with several deformation groove and an exhaust valve communicating with the high-pressure chamber and the compression chamber, and the deformation groove is arranged at one side of the bearing far away from the cylinder, so that a thin wall is formed between the bearing and the cylinder.

7. The rotary compressor with a low-pressure chamber according to claim 1, wherein the high-pressure air exhaust component comprises an air exhaust outlet arranged on the housing, an air exhaust mounting portion arranged on one side of the air exhaust outlet, an air exhaust connector arranged on the air exhaust outlet, a high-pressure copper pipe mounted on the air exhaust mounting portion, and a sealing element for fixedly connecting the high-pressure copper pipe with the air exhaust mounting portion, the sealing element is integrally formed with the high-pressure copper pipe, the air exhaust mounting portion is provided with a vent groove connected with the air exhaust outlet, and the sealing element comprises a sealing head and a connecting bolt, and the sealing head cooperates with the connecting bolt to fix the high-pressure copper pipe on the air exhaust mounting portion.

8. The rotary compressor with a low-pressure chamber according to claim 7, wherein the high-pressure copper pipe is arranged in a spiral shape, the high-pressure copper pipe is connected with the high-pressure air exhaust port, the high-pressure copper pipe is arranged around the pump assembly to realize intermediate cooling of the high-pressure refrigerant.

9. The rotary compressor with a low-pressure chamber according to claim 1, wherein the crankshaft comprises a shaft body and an eccentric section arranged on the shaft body, the eccentric section is arranged in the piston, the eccentric section is provided with an elastic deformation portion, and the elastic deformation portion comprises a convex portion protruding outwards and a deformation hole arranged in a side wall of the convex portion.

10. The rotary compressor with a low-pressure chamber according to claim 1, wherein a connecting component is further arranged between the pump assembly and the housing, a plurality of mounting lug bosses are arranged in the housing, a plurality of mounting positions are arranged on the pump assembly, the plurality of mounting lug bosses are uniformly distributed on the housing, and the connecting component is arranged between each of the plurality of mounting lug bosses and a corresponding one of the plurality of mounting positions to connect the pump assembly and the housing.

11. The rotary compressor with a low-pressure chamber according to claim 1, wherein a bottom portion of the housing is sunken downwards to form an oil storage tank, and the lubricating oil is arranged in the oil storage tank.

12. The rotary compressor with a low-pressure chamber according to claim 1, wherein an electronic control mounting portion is further arranged outside the housing, the electronic control mounting portion is integrally formed with the housing, the electronic control mounting portion cooperates with the housing to form an electronic control mounting chamber, and a bottom portion of the electronic control mounting chamber is provided with a mounting hole position for mounting an electronic control component.

13. An air conditioner, comprising the rotary compressor with a low-pressure chamber according to claim 1.

* * * * *